United States Patent [19]

Marshall et al.

[11] 3,964,178

[45] June 22, 1976

[54] UNIVERSAL INFANTRY WEAPONS TRAINER

[75] Inventors: Albert H. Marshall, Maitland; Frank J. Oharek; John H. Dillard, both of Orlando; Robert J. Entwistle, Winter Park, all of Fla.

[73] Assignee: The United States of America as represented by the Secretary of the Navy, Washington, D.C.

[22] Filed: July 3, 1975

[21] Appl. No.: 593,071

[52] U.S. Cl. ..... 35/25; 273/101.1

[51] Int. Cl.[2] ..... F41G 3/26

[58] Field of Search ..... 35/25; 273/101.1

[56] References Cited

UNITED STATES PATENTS

| | | | |
|---|---|---|---|
| 2,023,497 | 12/1935 | Trammell | 35/25 |
| 2,042,174 | 5/1936 | Foisy | 35/25 X |
| 2,406,574 | 8/1946 | Waller et al. | 35/25 |
| 2,418,512 | 4/1947 | Johnson | 35/25 |
| 2,445,982 | 7/1948 | Waller et al. | 35/25 |
| 2,662,305 | 12/1953 | Alric | 35/25 |
| 3,083,474 | 4/1963 | Knapp | 35/25 |
| 3,339,293 | 9/1967 | Kuhlo et al. | 35/25 |
| 3,811,204 | 5/1974 | Marshall et al. | 35/25 |
| 3,889,396 | 6/1975 | Aronson | 35/25 |
| 3,904,204 | 9/1975 | Yokoi | 35/25 |

*Primary Examiner*—William H. Grieb

*Attorney, Agent, or Firm*—R. S. Sciascia; J. W. Pease

[57] ABSTRACT

A universal weapon fire simulation system in which frames of motion picture film are employed to produce simultaneously from one set of frames a background area including a target and, from another set of frames, an infrared lead aim spot. The sets of film frames are coordinated in projection in a desired degree of non-registration between the lead spot and the target to provide a lead in the infrared spot representative of the correct lead and elevation of a properly aimed weapon. The invention also includes a receiver circuit comprising a quadrant arrangement of infrared detectors for sensing the infrared lead aim spot when the weapon is correctly aimed, and amplifier, comparator, logic and hit indicator means for indicating a miss, hit, or a specific area of near miss when the weapon is triggered to activate the sensor circuit.

8 Claims, 4 Drawing Figures

UNIVERSAL INFANTRY WEAPONS TRAINER

BACKGROUND OF THE INVENTION

The invention relates to the arts of optics and electronics in the field of simulation, and has particular reference to gunnery training via simulation and without the requirement of live ammunition.

Recently, simulators have been developed utilizing lasers and target associated detectors in weapon fire simulation systems. Also utilized have been lasers, retroreflective targets and weapon mounted laser beam detectors in weapon fire simulation systems.

SUMMARY OF THE INVENTION

The invention is directed to the features of realistic simulation of a variety of battlefield targets by movie film to provide a universal weapon trainer, to immediate feedback of score information while firing and without a myriad of detectors, and to a geometrical pattern of sensors in a receiver circuit to provide score information in the form of miss, hit, and area of near miss. In these respects, the subject invention employs movie film to project a background scene including a target and at the same time to project correct lead spots in the form of infrared spots with frames of background and frames of lead spots in non-registration to provide the proper aim point to score a hit under the condition of ammunition type, weapon type, range, target speed, etc., represented. The foregoing is combined with a multiple unit infrared sensor receiver circuit with the sensor units in a geometrically arranged pattern, selected to sense different areas of the target when the weapon is aimed, and a logic and indicator system including amplifiers, comparators, logic circuits and audio, visual and/or recording hit and miss indicator units to provide immediate feedback of specific data on score information while the trainee continues to fire and can thus make correction for his errors.

DESCRIPTION OF THE PREFERRED EMBODIMENT

Figure 1:
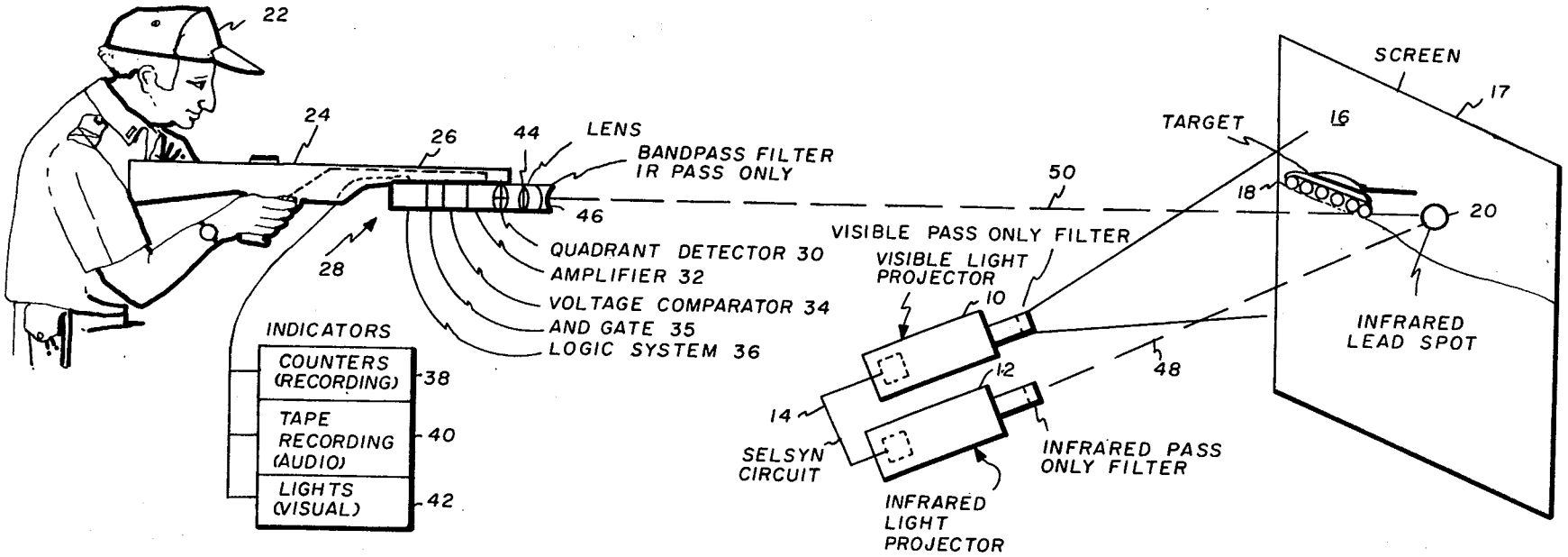
FIG. 1 is a schematic diagram of a weapon fire simulation system incorporating the invention.

Referring to the drawings, in FIG. 1 is shown schematically a weapon fire simulator for gunnery training incorporating the invention. The simulator as shown comprises projectors 10 and 12 connected by selsyn circuit 14 for coordinating the film frame drive of the two projectors to provide coordinated projections of a background scene 16, which includes a moving tank 18 and an infrared lead spot 20.

The necessary lead of the lead spot 20 for proper aim to hit the tank under given conditions is hand animated on the frames of the infrared spot film and maintained in adjusted relation to the background film by the selsyn system 14.

The trainee 22 is able to see background scene 16, including the moving tank 18, but is not able to see the infrared lead spot 20 representing the aiming point for proper lead in training the weapon 24. However, attached to the barrel 26 of the weapon 24 is a receiving circuit and indicators for sensing a hit, miss, or area of near miss on the spot 20 and providing an indication of the area of score. Thus, the receiving circuit indicated generally at 28 includes a quadrant detector 30, amplifiers 32, voltage comparators 34, and logic system 36. The indicators may be any suitable alarm or scoring means but are comprised in the instance of FIG. 1 as a counter 38, an audio system 40, and a visual system 42. A focusing lens 44 and bandpass filter 46 for infrared pass only are provided to pass the IR (infrared) beam 48 and 50 to the quadrant detector 30.

Figure 2A:
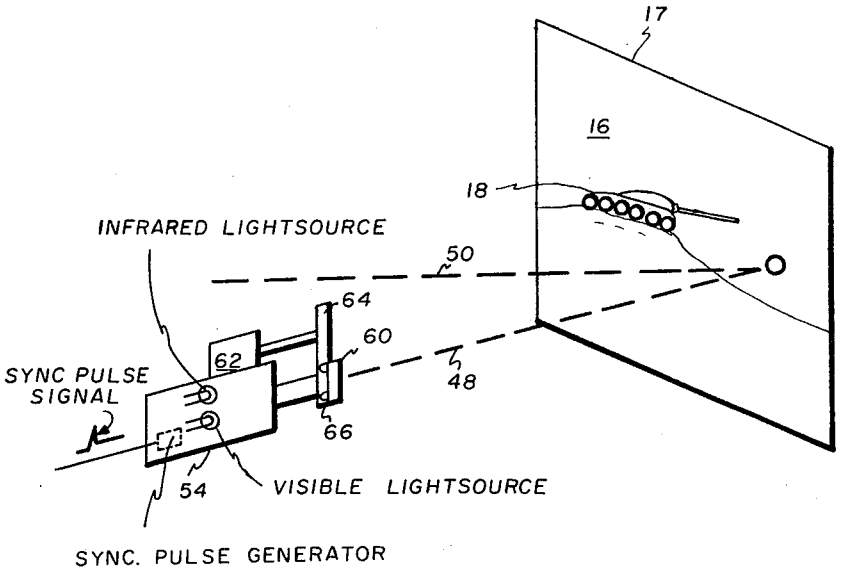
FIGS. 2A and 2B are schematics illustrating a modification of the system of FIG. 1 whereby a single film and single projector are employed to provide the necessary projections.
Figure 2B:
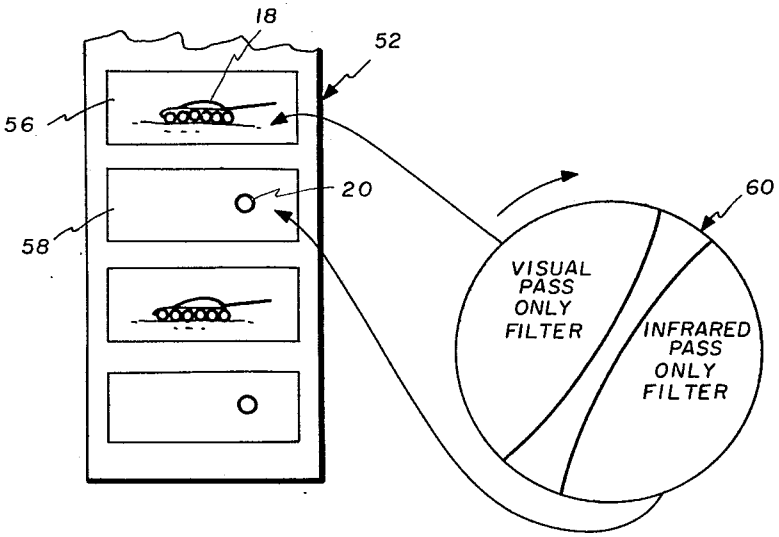

As thus far described the system includes dual projectors 10 and 12, each having a separate film and maintained in registered relation by selsyn circuit 14. In FIGS. 2A and 2B is shown a modification of the invention wherein a single film 52 it utilized in a single projector 54. The film 52 is comprised of alternate frames of background scene 16 including target tank 18 and infrared aiming spot 20; such frames are indicated at 56 and 58 in FIG. 2B. To eliminate IR (infrared) light from projection through frame 56 to the screen indicated at 17, and to eliminate visible light from projection through frame 58 to screen 17, a rotatable combination IR filter — visible light filter 60 is provided as shown in FIG. 2B. The filter 60 is rotatably driven such that the IR filter portion (indicated) rotates in front of the background scene frame 56 and the visible filter portion (indicated) rotates in front of the IR spot frame 58. In FIG. 2A is shown a motor drive including motor 62 and drive wheels 64 and 66 for rotating the filter 60.

Figure 3:
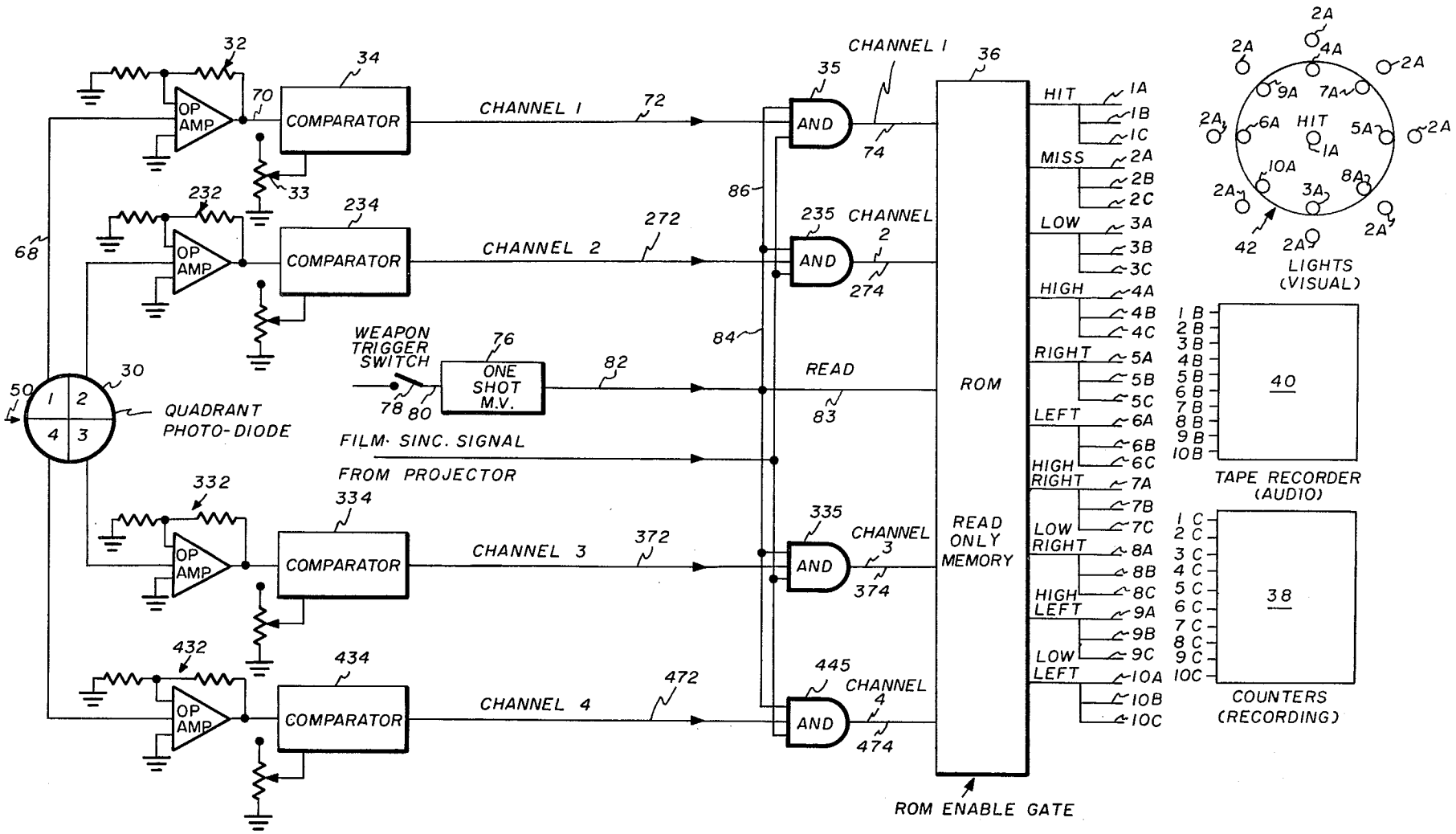
FIG. 3 is a circuit diagram showing details of amplifiers, comparators, logic and indicator circuitry shown in block form in FIG. 1.

FIG. 3 illustrates details of one suitable electrical circuit arrangement and components comprising the receiving sensor circuit and the three indicators providing visual, audio and recording response. Thus, in FIG. 3 is shown a quadrant detector 30 having four associated receiving channels (indicated). The channels 1, 2, 3 and 4 are connected through a common logic 36 to the separate indicators comprising lights (visual) 42, tape recorder (audio) 40 and counters (recording) 38. The individual quadrant sensors 1, 2, 3 and 4 of the quadrant detector 30 are connected through the respective channels indicated as 1 through 4 to the logic system 36. Thus, sensor 1 connects through line 68, amplifier 32, line 70, comparator 34 and line 72 as one input to a three input AND gate 35 and thence through a line 74 to logic circuit 36 which is a simple ROM (read only memory) programmed to energize one of ten different outputs in accordance with the input signals received from channels 1 through 4. This will be described in further detail hereinafter. AND gate 35 will provide an output to logic 36 only when three input signals are received. One of the remaining two signals is obtained from a one shot multivibrator 76 upon squeezing and thus closing the weapon trigger switch 78. The enabling trigger signal is passed on line 80, 82, 84 and 86 to the AND gate 35. This signal is required because one would not want the sensor 1 actuated unless the trainee pressed the trigger to obtain a score as he aimed the weapon. The other input required is a sync signal obtained via the film in the projector such that the AND gate 35 will be activated only when the film frame movement is in a stopped condition to avoid error otherwise introduced. The projector, as for example projector 54, includes a sync pulse generator 55 to provide the sync pulse signal (indicated) applied on line 83 to ROM 36.

The remaining channels 2, 3 and 4 comprise identical elements, arranged in the same manner as channel number 1 except that they are connected respectively to quadrant sensors 2, 3 and 4 as indicated. For convenience, corresponding elements are given the same last two digits with a prefix corresponding to the channel, as for example the amplifiers are designated 232 (channel 2), 332 (channel 3), and 432 (channel 4).

Considering the operation of the channels and taking channel 1 for first discussion, when the incoming infrared beam 50 does not hit quadrant sensor 1, there is no output on line 68 or substantially no output thereon, and the output from amplifier 32 on line 70 is substantially zero and in any event less than the adjustably selected reference voltage in comparator 34 set by the potentiometer 33. The output from comparator 34 is thus zero and the output from AND gate 35 is zero. This zero voltage corresponds to a digital zero input to the ROM 36 on line 74. In the same manner, a miss of quadrant sensors 2, 3 and 4 by beam 50 causes a digital zero input into the ROM 36 via the channel 2, 3 and 4 inputs identified as 274, 374 and 474. The resultant digital input, 0000, addresses the ROM 36 to provide an output on MISS lines 2*a*, 2*b* and 2*c* to indicate a miss on each of the indicators 42, 40 and 38. The read signal to the ROM 36 is obtained from the switch 78 and one shot multivibrator 76 via line 82 and read input line 83.

While the voltage comparator 34, 234, 334 and 434 will put out a digital zero level voltage when no sensor is hit, the reverse is true when a sensor is hit. That is, each voltage comparator will put out a digital one level voltage whenever the input voltage thereto exceeds the reference level voltage set by its associated adjustable potentiometer. When all quadrant sensors are hit, all comparators 34, 234, 334 and 434 put out a digital one level voltage and a digital one input is passed via the gates 35, 235, 335 and 435 as inputs to the ROM 36. Such an input of digital 1111 addresses the ROM 36 to provide an output on the HIT lines 1*a*, 1*b* and 1*c* which energize the hit portions of indicators 42, 40 and 38. When one or more but not all of the quadrant sensors are hit, various digital inputs are developed to address the ROM 36 and the ROM is programmed to energize the various output lines indicated in accordance to the received input digital number.

One suitable programming of the ROM 36 is as follows:

| Quadrant Sensors Hit | ROM Digital Input | ROM Output Lines Energized |
|---|---|---|
| 0000 | 0000 | MISS 2a, 2b, 2c |
| 1234 | 1111 | HIT 1a, 1b, 1c |
| 0034 | 0011 | LOW 3a, 3b, 3c |
| 1200 | 1100 | HIGH 4a, 4b, 4c |
| 0230 | 0110 | RIGHT 5a, 5b, 5c |
| 1004 | 1001 | LEFT 6a, 6b, 6c |
| 0200 | 0100 | HIGH RIGHT 7a, 7b, 7c |
| 0030 | 0010 | LOW RIGHT 8a, 8b, 8c |
| 1000 | 1000 | HIGH LEFT 9a, 9b, 9c |
| 0004 | 0001 | LOW LEFT, 10a, 10b, 10c |

The above provides a total of ten hit and miss output signals representing locations which can be applied to visual, audio and recording indicators as well be described hereinafter. It is to be noted that the invention is not limited to a quadrant arrangement of quadrant sensors, as more sophisticated expanded arrangements providing additional outputs and corresponding indicators could be employed.

Continuing with FIG. 3 and considering the indicators, the visual indicator 42 comprises an arrangement of lights easily read in relation to the ten outputs provided by the ROM 36. Thus, under the condition of a complete miss the output 2*a* being connected to all of the perimeter lights, correspondingly marked 2*a*, provide an outer ring of lights energized when a miss is recorded on indicator 42. The hit output 1*a* of ROM 36 is connected to light 1a at the center of the lights arrangement, indicator 42, and indicates a direct hit on all four quadrants of quadrant detector 30. In FIG. 3 each light is numbered with the corresponding number of the ROM output line which indicates the score and which will energize a light at the proper location such as 3*a* (low), 4*a* (high), 5*a* (right), 6*a* (left), etc.

In the audio indicator a tape recorder 40 is provided which has ten individual tapes which may be energized from the recorder terminals 1*b* through 10*b* connected respectively to the 1*b* through 10*b* outputs of ROM 36. On each tape is repeated a word or sequence of words representative of the score such as hit, miss, low, right, etc.

Advantage of the recording indicator 38 is that it provides a record for later review of each student's score, the accumulative score of a group, and any specific fault which appears to be repeated and requires efforts to correct in training.

An advantage of the audio indicator 40 is the assistance given the trainee to tell him what he is doing wrong while he is still firing, and without the need to take his eyes off the target.

The indicator system provides an advantage in giving an immediate feedback of the score to the instructor, audio as well as visual, shot by shot, such that the instructor can also watch the trainee to see what it is that is causing error and thus be in a position to give immediate corrective instruction.

What is claimed is:

1. A weapon fire simulation system comprising projection apparatus and film, said film being processed to provide from a first series of film frames a background scene including a target area and from a second series of film frames a lead aim spot;

said projection apparatus having a source of visible light for passing through said first series of film frames and a source of infrared light for passing through said second series of film frames;

drive means for coordinately driving said film frames in a desired degree of non-registration between said aim spot and said target area representative of the correct lead and elevation for a proper aiming of said weapon;

a projector screen for viewing said film frames;

a filter selected and positioned to filter all except infrared light from passing from said second film frames to said screen to provide an infrared aim spot on said screen and a filter selected and positioned to filter infrared light from passing from said first film frames to said screen;

a plurality of infrared sensor circuits, each forming a sensor channel and each comprising an infrared sensor and amplifier and voltage comparator means;

said sensor being arranged in a geometrical pattern to develop from each sensor when the weapon is aimed and fired, a channel output signal indicative of hit or miss; and a logic circuit for receiving the output signals of each sensor channel to produce from the combined sensor signals an ultimate output signal indicative of hit, miss, and specific area of near miss.

2. Apparatus according to claim 1 including an audio system of pre-recorded messages actuable from said ultimate output signal to produce an audio call of the exact area hit while the trainee still has his point of aim and can see what he has done incorrectly.

3. Apparatus according to claim 1, said film comprising in a single reel, alternately spaced frames of said first and second series of frames, and rotatable filter means for presenting an infrared pass only filter to said second series of frames and a visible light only pass filter to said first series of film frames.

4. Apparatus according to claim 1, said film comprising separate reels of said respective first and second series of frames;

said projection apparatus comprising a separate projector for each of said reels; and said filter means being positioned with a visible light pass filter and an infrared pass filter respectively between said first and second series film frames and said screen.

5. Apparatus according to claim 1, said pattern arrangement being a quadrant arrangement of infrared sensors.

6. Apparatus according to claim 1, said projector means having a film sync signal generator;

said logic circuit comprising a trigger switch and one shot multivibrator;

a triple enabling input AND gate for each sensor channel;

said AND gate being connected to receive inputs from said multivibrator, said sync signal generator, and from its associated channel signal output to provide a digital "zero" output signal when any input is zero, and otherwise to provide a digital "one" output; and a ROM connected to receive said digital inputs and programmed to energize specific ROM output lines corresponding to the digital number inputs from said AND gate and hence to the activation or lack of activation, or combination of both, relating to said sensors.

7. Apparatus according to claim 6, including indicator means having a plurality of input lines connectable each to one of said ROM output lines;

said indicator means having the capability of producing a different signal for each input line energized to thereby indicate to a trainee a hit, miss, or a specific area of near miss.

8. Apparatus according to claim 7, including indicator means comprising a multi-array of lights, a multichannel tape recorder and a multichannel counter, each having an input connected to a corresponding output of said ROM to provide visual, audio and recorded indication of miss, hit, and area of near miss, responsive to the activation or lack of activation of said sensors.

* * * * *